US006488429B2

(12) United States Patent
Korper

(10) Patent No.: US 6,488,429 B2
(45) Date of Patent: Dec. 3, 2002

(54) PRESSURE MODULATED FREE INK MARKER FOR PRODUCING VARIABLE LINE WIDTH

(76) Inventor: George W. Korper, 13950 Kennard Dr., Glenelg, MD (US) 21737

( * ) Notice: Subject to any disclaimer, the term of this patent is extended or adjusted under 35 U.S.C. 154(b) by 0 days.

(21) Appl. No.: 09/951,526

(22) Filed: Sep. 14, 2001

(65) Prior Publication Data

US 2002/0025214 A1 Feb. 28, 2002

Related U.S. Application Data

(60) Provisional application No. 60/185,159, filed on Feb. 14, 2000.

(51) Int. Cl.[7] ..... B43K 5/04; B43K 5/18

(52) U.S. Cl. ..... 401/186; 401/183; 401/184; 401/185; 401/199; 401/205; 401/206

(58) Field of Search ..... 401/199, 198, 401/202, 205, 206, 186, 185, 184, 183

(56) References Cited

U.S. PATENT DOCUMENTS

| | | | | |
|---|---|---|---|---|
| 3,972,629 A | * | 8/1976 | Whalen, Jr. | 401/199 |
| 4,496,258 A | * | 1/1985 | Tanaka et al. | 401/199 X |
| 4,588,319 A | * | 5/1986 | Niemeyer | 401/199 X |
| 4,671,692 A | * | 6/1987 | Inaba | 401/199 |
| 5,387,046 A | | 2/1995 | Danno | |
| 5,421,664 A | | 6/1995 | Okamoto | |
| 5,556,215 A | * | 9/1996 | Hori | 401/199 |
| 5,707,164 A | | 1/1998 | Iwamoto et al. | |
| 5,885,020 A | | 3/1999 | Rossi | |
| 5,909,978 A | | 6/1999 | Giordano et al. | 401/199 X |

FOREIGN PATENT DOCUMENTS

| | | |
|---|---|---|
| WO | WO 01/62519 | 8/2001 |

* cited by examiner

*Primary Examiner*—David J. Walczak
*Assistant Examiner*—Kathleen J. Prunner
(74) *Attorney, Agent, or Firm*—Edell, Shapiro, Finnan & Lytle, LLC

(57) ABSTRACT

A liquid marker system utilizes three primary components to permit marking of lines of various widths from a single nib. The three components are a porous nib, a transfer wick and a squeezable container. Operation relies on different squeeze pressures applied to the housing to produce different line widths from the single nib as the nib is moved across a marked surface. The porous wick provides a resistance to flow until the bottle is squeezed and then supplies a minimum of capillary flow to the nib. The user squeezes the container to overcome the resistance of the wick. No venting of the container interior is required because the wick and nib system allows the passage of air into the container when the container is returned to its unstressed (i.e., un-squeezed) condition.

17 Claims, 6 Drawing Sheets

PRESSURE MODULATED FREE INK MARKER FOR PRODUCING VARIABLE LINE WIDTH

CROSS-REFERENCE TO RELATED APPLICATIONS

This application claims priority from U.S. Provisional Patent Application Serial No. 60/185,159, entitled "Pressure Modulated Free Ink Marker For Producing Variable Line Width" and filed Feb. 14, 2000, the disclosure of which is incorporated herein by reference in its entirety.

BACKGROUND OF THE INVENTION

1. Technical Field

The present invention pertains to improvements in liquid markers and more particularly, to free ink marker systems and methods utilizing pigments, paints, dyes, liquid chalk, etc.

2. Discussion of the Art

Various prior art markers permit marking fluids to be squeezed from a container through a porous nib; however, such markers have lacked the ability to control or modulate the delivery rate as required for detailed drawing, calligraphy, and other detail oriented applications. Moreover, squeeze containers are typically subject to leakage due to pressure variations and temperature changes. Other prior art marker designs utilize ink housed in absorbent fibers and transferred by capillary action to a porous nib.

Conventional liquid markers can only effect differing line widths by using a differently sized and/or configured nibs for each desired line.

OBJECTS AND SUMMARY OF THE INVENTION

It is an object of the invention to provide a liquid marker delivery method and apparatus in which the marker liquid can be squeezed from a container in a manner that permits close control over the delivery rate of the liquid.

It is another object of the invention to provide a liquid marker delivery method and apparatus capable of producing different line widths and effects with a single nib.

The aforesaid objects are achieved individually and in combination, and it is not intended that the present invention be construed as requiring two or more of the objects to be combined unless expressly required by the claims attached hereto.

In accordance with the present invention, a marker system utilizes three primary components to permit the marker to produce lines of various widths from a single nib. The three primary components are a porous nib, a transfer wick and a squeezable container or housing in which the wick and nib are disposed with the nib protruding from one end thereof. Stated otherwise, the present invention combines a porous wick utilized in conjunction with a squeezable plastic tube or bottle and a porous plastic or felt nib. System operation relies on different squeeze pressures applied to the housing to produce different line widths from the single nib. Squeeze bottles without a wick are subject to leakage due to pressure variations and temperature changes. The porous wick of the present invention provides a resistance to flow until the bottle is squeezed and then supplies a minimum of capillary flow to the nib. The wick resistively blocks flow of the marker liquid to the porous nib in the absence of pressurization of the enclosed volume of the housing to a predetermined level above ambient pressure. The user squeezes the container to overcome the resistance of the wick, and can supply marker fluid to the nib at volumes directly related to the squeeze pressure. In response to squeezing or compressing the housing or container to pressurize the enclosed volume to the predetermined level, the capillary flow of the contained marker liquid is delivered from the enclosed volume to the nib. As used herein the terms "wick" and "wick member" refer to a device capable of drawing liquid along surfaces thereof (i.e., by virtue of the very nature of its material and the nature of the liquid), or through one or more capillary orifices defined through the member, to provide the liquid delivery requirements described herein.

The simple device of the present invention requires no venting to atmosphere of the container interior because the wick and porous nib system allows the passage of air into the container. The porosity of the porous nib forms an aspiration means for permitting entry of the ambient air into the enclosed volume in response to the pressure in the enclosed volume dropping below ambient pressure. A channel defined in the periphery of the nib and a channel defined in a portion of the housing surrounding the nib also aid the aspiration means. Specifically, when the container is returned to its unstressed (i.e., un-squeezed) condition, ambient air is aspirated back into the container through the nib-wick system.

The squeeze pressure required to emit marker fluid from the container interior is set to be greater than any atmospheric differential pressure that would normally be experienced in the use of the marker system. In this manner, the marker system operates properly in airplanes, at different ground elevations, etc., without leaking due to pressure differentials.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DETAILED DESCRIPTION OF THE INVENTION

Figure 1:
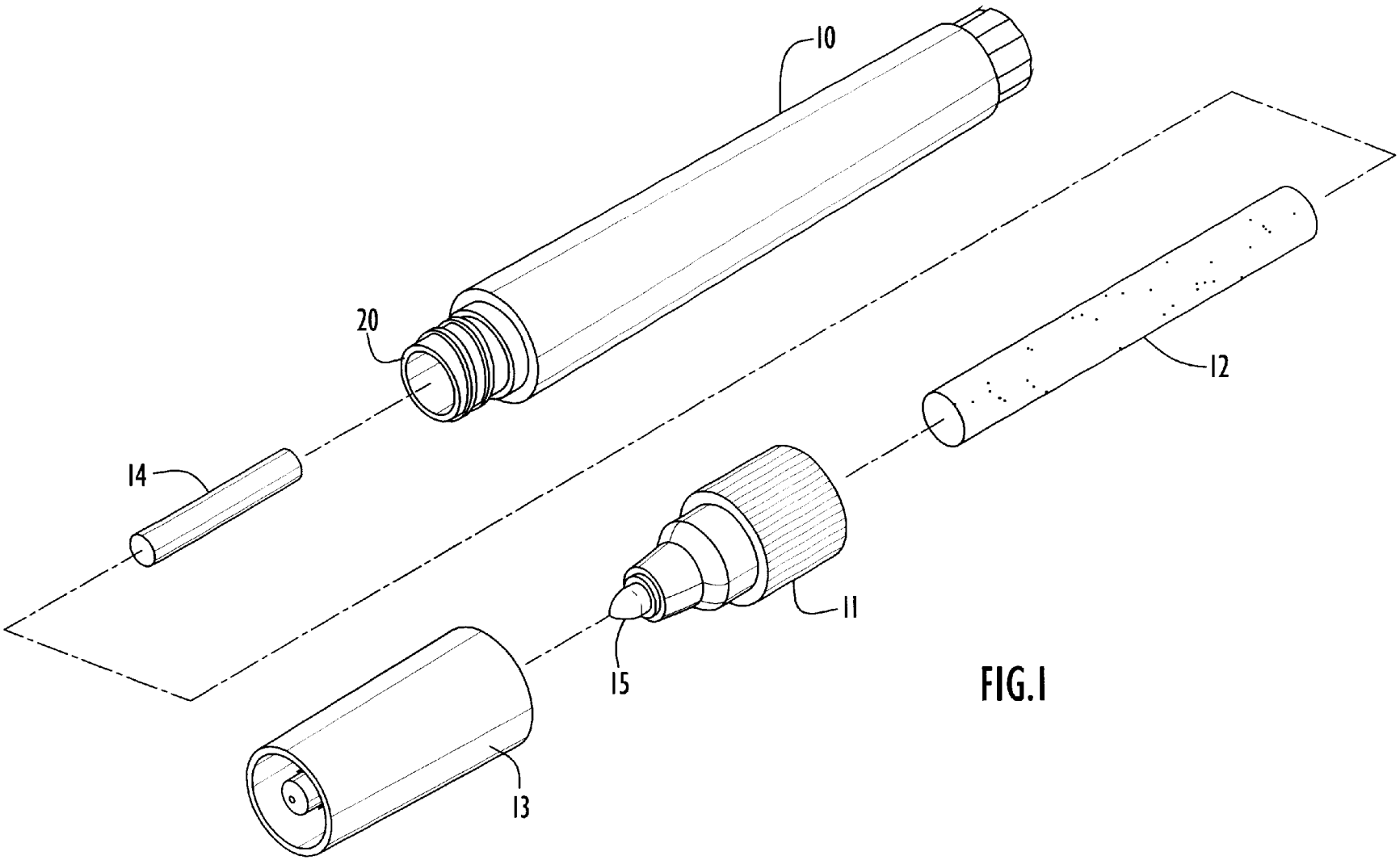
FIG. 1 is an exploded view in perspective of a preferred embodiment of the marker system of the present invention.
Figure 2:
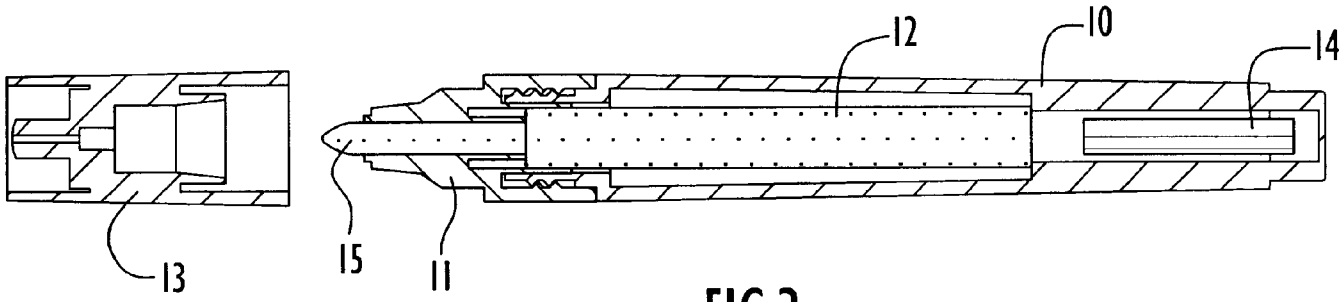
FIG. 2 is a view in longitudinal section of the embodiment of FIG. 1.

Referring to FIGS. 1 and 2, a marker system constructed in accordance with the present invention includes a housing formed of resiliently squeezable material. The housing is adapted to be hand-held and comprises a hollow barrel 10 defining an enclosed volume containing the marker liquid and having an externally threaded distal end 20 to which an internally threaded end piece 11 is threadedly engaged. The housing is elongated and generally cylindrical and is formed of a material that is resiliently squeezable along the entire length of the housing. The interior of end piece 11 is hollow and communicates with the hollow interior of barrel 10. Projecting from the forward end of end piece 11 is a porous nib 15, the rearward portion of which extends into the hollow interior of end piece 11. The end piece 11 secures the porous nib 15 in the housing when the end piece 11 is engaged with the housing. Nib 15 is made of conventional porous material of the type typically used in marker devices and is configured as a solid cylinder with a tapered distal tip. The taper is preferably gradual such that the tip appears more parabolic than conical.

A transfer means in the form of a generally cylindrical fibrous filler member or transfer wick 12 formed of porous material is disposed within the housing for providing resistance to flow of liquid therethrough. The fibrous filler member or transfer wick 12 has its leading end preferably abutting or in contact with the rearward end of nib 15. The resistance of the transfer means is sufficient to block liquid flow in the absence of a predetermined pressure drop distally across the transfer means but delivers capillary flow of the contained marker liquid from the enclosed volume to the nib 15 in response to pressurization of the enclosed volume equal to at least the predetermined pressure above ambient pressure. A mixing slug or agitator 14 may optionally be disposed within the housing to facilitate mixing of marker fluid disposed in the reservoir formed by the housing. Specifically, shaking the housing causes slug 14 to mix the fluid in the reservoir.

Figure 3:
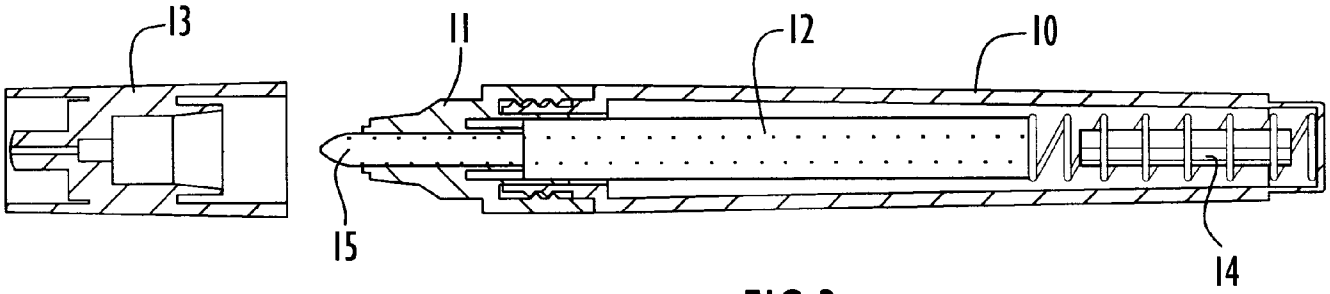
FIG. 3 is a view in longitudinal section of a modified version of the embodiment of FIG. 1.

A removable cap 13 can be secured by friction fit over the end piece 11 to cover nib 15 when the unit is not in use. Removal of cap 13 exposes the nib 15. As illustrated in FIG. 3, a helical spring may be disposed between the rearward end of transfer wick 12 and the interior surface of the proximal end wall of barrel 10 to urge the wick into biased longitudinal engagement with the rearward end of nib 15.

Figures 4, 5:
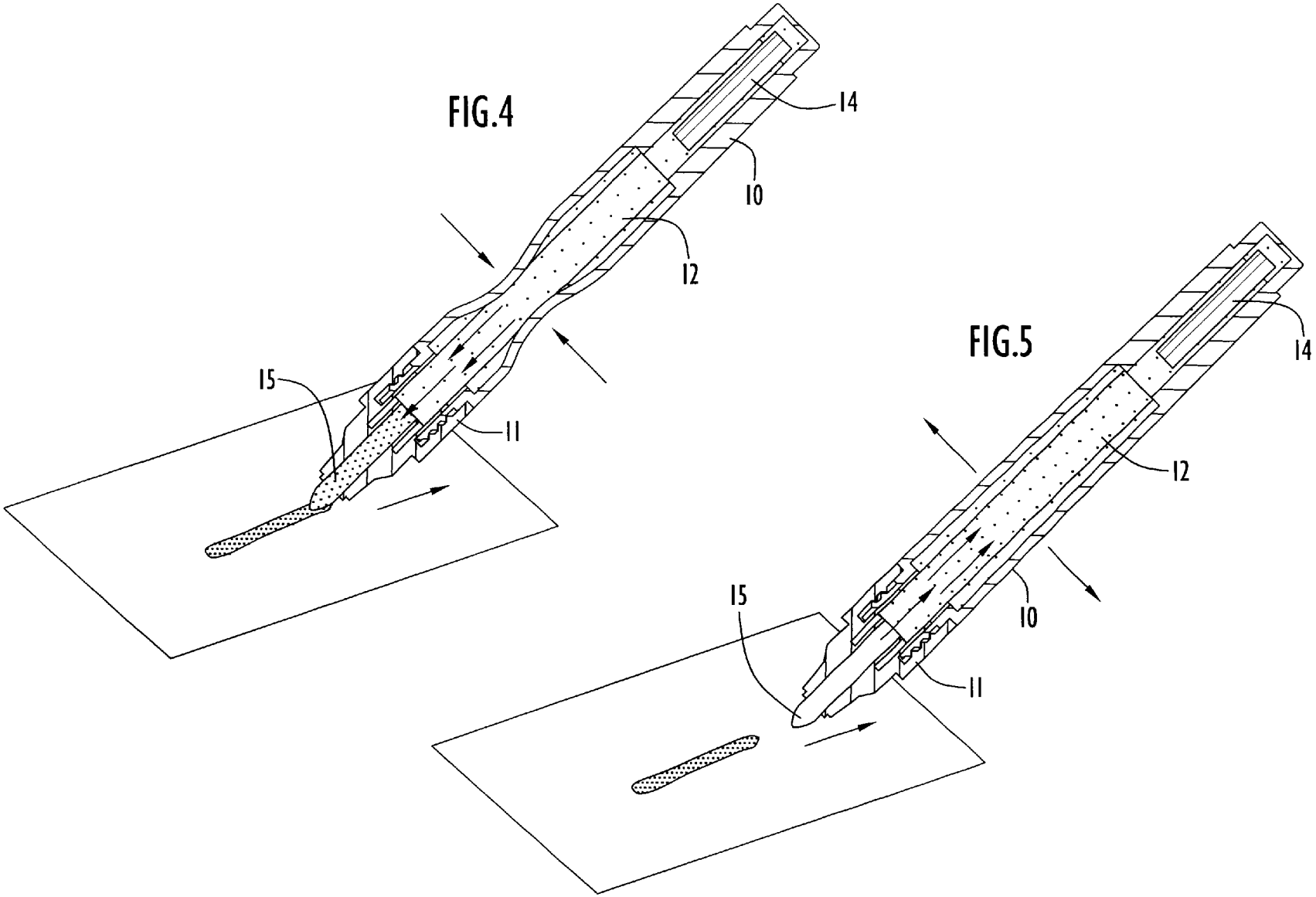
FIG. 4 is a view in perspective and longitudinal section of the embodiment of FIG. 1 shown during the delivery of marker fluid.
FIG. 5 is a view in perspective and longitudinal section of the embodiment of FIG. 1 shown immediately following the delivery of marker fluid.

As best illustrated in FIG. 4, with cap 13 removed, marker liquid may be forced out of the housing by squeezing the resilient sidewall of barrel 10 radially inward until the pressure created in the internal reservoir exceeds ambient atmospheric pressure at the exposed forward end of nib 15. Liquid disposed in and about wick 12 is forced through the porous nib and out through the forward end of end piece 11 onto a surface, such as a sheet of paper, at a flow rate dependent upon the applied pressure. This applied pressure, and hence the resulting flow rate of the marker liquid, determines the width of the line made by the nib as it traverses the marked surface. That is, the amount of liquid deposited at any point on the marked surface depends upon the speed of movement of the nib across the marked surface and the squeeze pressure induced flow rate of the liquid. The applied finger pressure on barrel 10 distorts the transfer wick 12 to the degree necessary to force liquid therefrom into and through the porous nib 15.

The porous transfer wick 12 provides resistance to flow until the barrel 10 is squeezed and then supplies a minimum of capillary flow to the nib. The user squeezes the barrel to overcome the resistance of the wick, permitting supply of marker fluid to the nib at volumes and flow rates directly related to the squeeze pressure.

As illustrated in FIG. 5, upon release of the finger pressure on barrel 10, a negative pressure (relative to the ambient atmosphere) is created within the reservoir as the barrel wall resiliently returns to its unstressed state. This negative pressure, which comprises an aspiration means for permitting entry of ambient air into the enclosed volume in response to the pressure in the enclosed volume dropping below ambient pressure, draws ambient air into the reservoir along with liquid disposed on and in the porous nib 15. Accordingly, marker fluid on or in the nib is drawn by suction back into the reservoir, thereby preventing leakage of the marker fluid after the finger pressure is removed from the barrel.

Figure 7A:
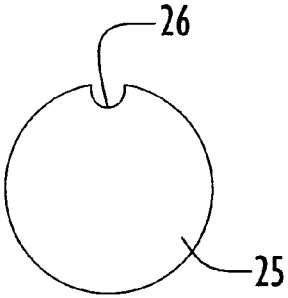
FIG. 7*a* is a view in transverse section of the nib employed in the embodiment of FIG. 6.
Figure 7B:
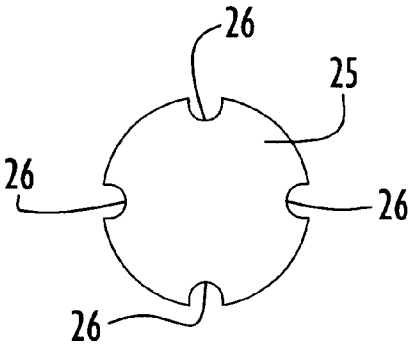
FIG. 7*b* is a view in transverse section of a nib having plural channels defined therein.
Figure 6:
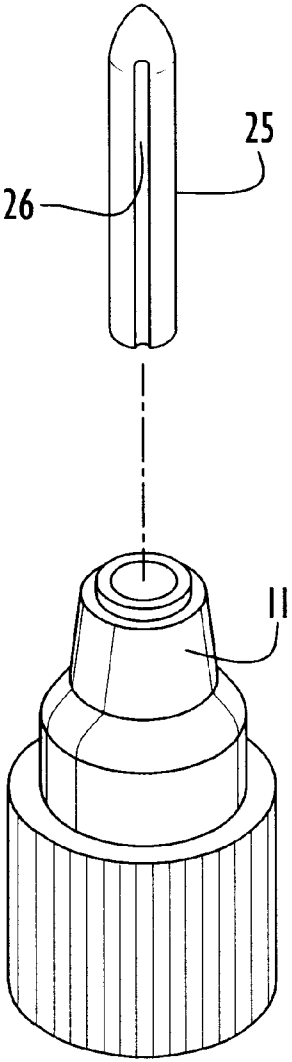
FIG. 6 is an exploded view in perspective of the distal end portion of another marker of the present invention incorporating a modified nib with a channel defined therein.

In order to aid in aspiration of ambient air upon release of finger pressure, it is desirable in some embodiments of the invention to provide a channel defined longitudinally along the nib periphery. One such embodiment is illustrated in FIGS. 6, 7*a* and 7*b*. Nib 25 is seen to have a shallow channel 26 extending longitudinally along the cylindrical portion of the nib, stopping short of the tapered distal tip. Channel 26 conducts ambient air into the reservoir when a negative pressure (relative to ambient) is created therein when the squeezing force is removed from the barrel. If desired, a plurality of longitudinal channels 26 may be defined in the nib periphery as illustrated in FIG. 7*b*.

Figure 8:
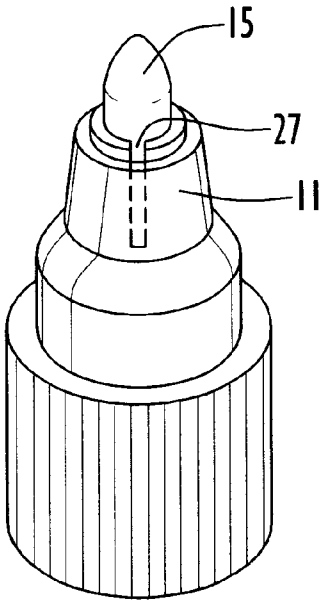
FIG. 8 is a view in perspective of the distal end portion of another marker of the present invention incorporating a channel in the housing portion surrounding the nib.

It is also possible to provide the aspiration-assisting channels in the housing portion engaging the nib rather than in the nib itself. An example of this may be seen in the embodiment of FIG. 8 wherein a longitudinally extending channel 27 is defined in the interior surface of end piece 11.

Figure 12:
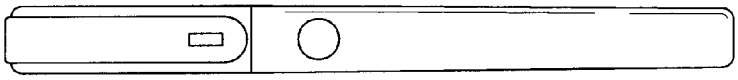
FIG. 12 is a side view in elevation of another marker embodiment of the present invention in which the housing is in the form of a pocket pen having a squeeze button actuator to control marker fluid outflow.
Figure 11:
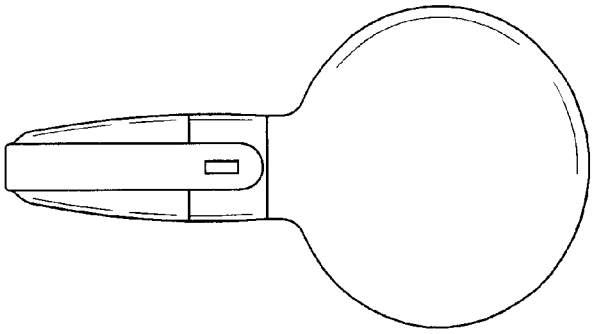
FIG. 11 is a side view in elevation of another marker embodiment of the present invention in which the housing is a squeeze bottle having flattened sides.
Figure 10:
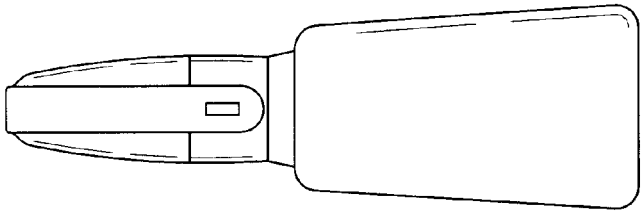
FIG. 10 is a side view in elevation of another marker embodiment of the present invention in which the housing is a squeeze bottle.
Figure 9:
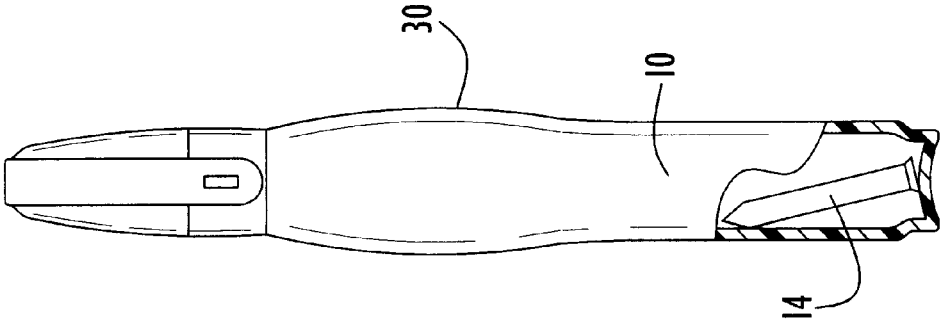
FIG. 9 is a side view in elevation of another marker embodiment of the present invention in which the housing is widened to facilitate control of fluid outflow.

Referring to FIG. 9, the squeezable barrel 10 may be configured with a resiliently squeezable compressible portion having a bulbous outwardly convex bulge 30 to provide a greater range of squeeze distance and more control over the delivery of marker liquid. The housing or "barrel" may also take the form of a smaller cylindrical or slightly frusto-conical squeeze bottle (FIG. 10), or a generally circular or elliptical squeeze bottle having flat sides (FIG. 11). Alternatively, the housing may be squeezably compressible only at a small portion or a localized section, or have a squeezable button to pressurize the barrel interior as shown in FIG. 12. Alternatively, the entirety of the housing may be formed of resiliently squeezable material.

Figure 13:
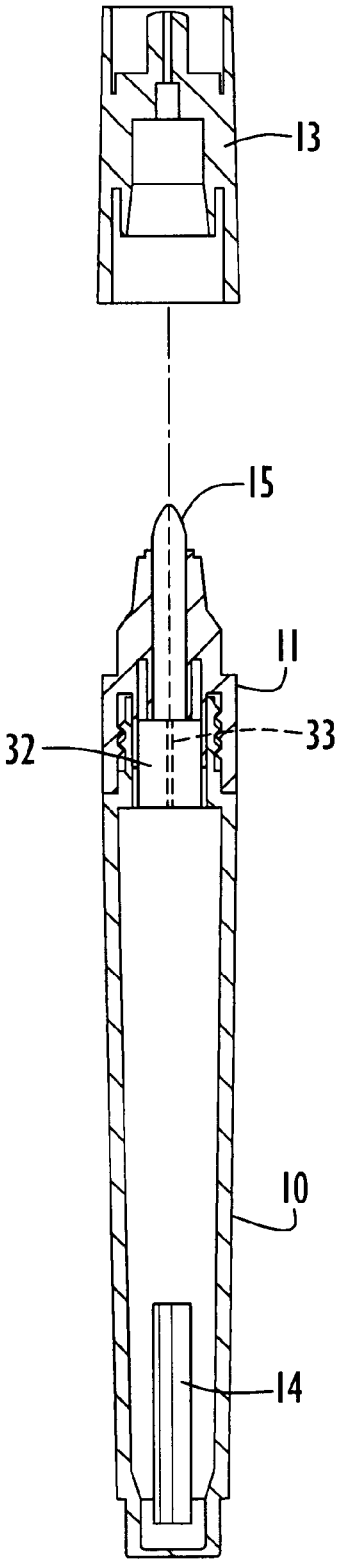
FIG. 13 is an exploded side view of another marker embodiment of the present invention in which the wicking function is provided by a capillary orifice extending through the wick member.
Figure 14:
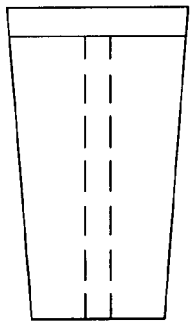
FIG. 14 is a side view in longitudinal section of the wick member used in the embodiment of FIG. 13.
Figure 15:
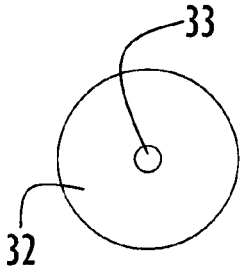
FIG. 15 is a top view in plan of the wick member of FIG. 14.
Figure 16:
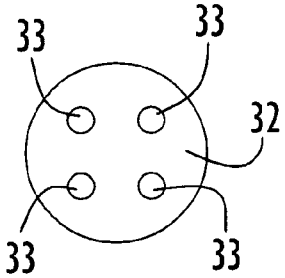
FIG. 16 is a top view in plan of a modified wick member having plural capillary orifices.

The wick member 12 in the embodiment of FIG. 1 is made from materials commonly used for this purpose, such as felt, porous thermoplastic material, fibrous material, etc. The material, by its nature, "wicks" or draws the marker liquid by capillary action along the material surface to the nib. The wicking function is well known and is described, for example, in U.S. Pat. No. 3,972,629 (Whalen), the entire disclosure of which is incorporated herein by reference. For purposes of the present invention, and as illustrated in FIGS. 13 through 16, the wicking function may also be effected by providing one or more narrow orifices or capillaries extending longitudinally through a "wicking" member. The orifices serve the wicking function due to the surface tension on the liquid created in the narrow orifice. The transfer means or wicking member 32 shown in FIGS. 13–15 is a solid body made of any suitable material that is not itself "wicking" and is provided with at least one narrow capillary passage or orifice 33 defined longitudinally therethrough in communication between the enclosed volume and the nib. Member 32 is substantially shorter than wick 12, and functions in response to pressurization of the interior of barrel 10 by conducting liquid to the nib 15. Member 32 is retained in end piece 11 proximally (i.e., immediately rearward) of nib. The distal end of member 32 abuts the proximal end of nib 15 at the egress end of orifice 33, whereby the "wicked" liquid is directed into the porous nib. As shown in FIG. 16, wicking member may be provided with a plurality of capillary passages or orifices.

The marker system described is applicable to all sorts of liquid pigments, paints, dyes, liquid chalks, etc., so that it can be used for a variety of applications, including lettering, painting, drawing, calligraphy, etc. The invention is the utmost in simplicity in requiring only three basic elements, namely the porous nib, the transfer wick and the squeezable reservoir. The reservoir may be in the form of a marker device as shown, a bottle, or any other form and shape consistent with the end use of the device.

The invention is highly advantageous in that it operates in an on/off manner with regard to liquid flow so that there is no dripping or spillage, no matter the orientation of the marker.

Having described preferred embodiments of new and improved liquid marker delivery method and apparatus, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A marker system for delivering marker liquid to a surface to be marked, said system comprising:

a housing adapted to be hand-held and defining an enclosed volume containing the marker liquid, said housing having a distal end;

a porous marker nib secured in said housing and having a tip projecting from said distal end of said housing; and transfer means disposed within said housing for providing resistance to flow of liquid therethrough, said resistance being sufficient to block said flow in the absence of a predetermined pressure drop distally across said transfer means, but delivering capillary flow of the contained marker liquid from said enclosed volume to said nib in response to pressurization of said enclosed volume equal to at least said predetermined pressure above ambient pressure;

wherein said housing is at least partially resiliently squeezably compressible by a human hand in which the housing is held to permit selective pressurization of said enclosed volume.

2. The system of claim 1 wherein the entirety of said housing comprises a resiliently squeezable material.

3. The system of claim 1 wherein said housing is squeezably compressible only at a localized section of the housing.

4. The system of claim 1 wherein said transfer means comprises a wick of porous material abutting said nib.

5. The system of claim 4 wherein said housing is elongated and generally cylindrical and is comprised of a material that is resiliently squeezable along the entire length of the housing.

6. The system of claim 4 wherein said housing is elongated and generally cylindrical with a bulbous outwardly convex portion that is resiliently squeezably compressible.

7. The system of claim 4 wherein said housing is elongated and generally cylindrical with only a small portion of said housing being resiliently compressible.

8. The system of claim 1 wherein said transfer means comprises a solid body having at least one capillary passage defined longitudinally therethough in communication between said enclosed volume and said nib.

9. The system of claim 8 wherein said housing is elongated and generally cylindrical and is comprised of a material that is resiliently squeezable along the entire length of the housing.

10. The system of claim 8 wherein said housing is elongated and generally cylindrical with a bulbous outwardly convex portion that is resiliently squeezably compressible.

11. The system of claim 8 wherein said housing is elongated and generally cylindrical with only a small portion of said housing being resiliently compressible.

12. The system of claim 1 wherein said transfer means comprises a solid body having a plurality of capillary passages defined longitudinally therethough in communication between said enclosed volume and said nib.

13. The system of claim 1 further comprising aspiration means for permitting entry of ambient air into said enclosed volume in response to the pressure in said enclosed volume dropping below ambient pressure.

14. The system of claim 13 wherein said aspiration means comprises porosity in said nib.

15. The system of claim 13 wherein said aspiration means comprises a channel defined in the periphery of said nib.

16. The system of claim 13 wherein said aspiration means comprises a channel defined in a portion of the housing surrounding said nib.

17. A method of providing controllable delivery of marker liquid to a surface to be marked, said method comprising the steps of:

(a). disposing the marking liquid in a squeezably compressible container defining an enclosed volume;

(b). securing a porous nib to a distal end of said container;

(c). resistively blocking flow of the marker liquid to said porous nib in the absence of pressurization of said enclosed volume to a predetermined level above ambient pressure; and (d). in response to compressing said container sufficiently to pressurize said enclosed volume to said predetermined level, delivering capillary flow of the contained marker liquid from said enclosed volume to said nib.

* * * * *